US009874849B2

(12) United States Patent
Yoshida

(10) Patent No.: US 9,874,849 B2
(45) Date of Patent: Jan. 23, 2018

(54) OPENING/CLOSING DEVICE AND IMAGE FORMING APPARATUS

(71) Applicant: FUJI XEROX CO., LTD., Tokyo (JP)

(72) Inventor: Michiaki Yoshida, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/226,985

(22) Filed: Aug. 3, 2016

(65) Prior Publication Data

US 2017/0277114 A1 Sep. 28, 2017

(30) Foreign Application Priority Data

Mar. 22, 2016 (JP) ..... 2016-057472

(51) Int. Cl.
*G03G 15/00* (2006.01)
*G03G 21/16* (2006.01)

(52) U.S. Cl.
CPC ..... *G03G 21/1623* (2013.01); *G03G 21/1633* (2013.01); *G03G 21/1638* (2013.01)

(58) Field of Classification Search
CPC ..... G03G 21/1623; G03G 21/1633; G03G 21/1638
See application file for complete search history.

(56) References Cited

U.S. PATENT DOCUMENTS

2013/0195505 A1* 8/2013 Hashimoto ..... G03G 21/1633 399/110

FOREIGN PATENT DOCUMENTS

JP 2004-045585 A 2/2004

* cited by examiner

*Primary Examiner* — Hoang Ngo
(74) *Attorney, Agent, or Firm* — Sughrue Mion, PLLC

(57) ABSTRACT

Provided is an opening/closing device including an opening/closing member that rotates to open and close an opening of a housing, a shaft member that is formed at a portion on one side of the opening/closing member and is formed of a shaft about which the opening/closing member rotates with respect to the housing, a grip portion that is formed at a portion on the other side of the opening/closing member and is gripped by a user, a meshed portion that is formed at a portion on the other side of the opening/closing member and meshes with a meshing portion formed at the housing, and a restraint unit that is formed at a portion on one side of the opening/closing member and restrains the opening/closing member from being deformed due to a release of meshing of the meshing portion with the meshed portion.

18 Claims, 14 Drawing Sheets

OPENING/CLOSING DEVICE AND IMAGE FORMING APPARATUS

CROSS-REFERENCE TO RELATED APPLICATIONS

This application is based on and claims priority under 35 USC 119 from Japanese Patent Application No. 2016-057472 filed Mar. 22, 2016.

BACKGROUND

Technical Field

The present invention relates to an opening/closing device and an image forming apparatus.

SUMMARY

According to an aspect of the invention, there is provided an opening/closing device including:

an opening/closing member that rotates to open and close an opening of a housing;

a shaft member that is formed at a portion on one side of the opening/closing member and is formed of a shaft about which the opening/closing member rotates with respect to the housing;

a grip portion that is formed at a portion on the other side of the opening/closing member and is gripped by a user;

a meshed portion that is formed at a portion on the other side of the opening/closing member and meshes with a meshing portion formed at the housing, with the opening/closing member disposed at a closing position where the opening of the housing is closed; and a restraint unit that is formed at a portion on one side of the opening/closing member and restrains the opening/closing member from being deformed due to a release of meshing of the meshing portion with the meshed portion.

BRIEF DESCRIPTION OF THE DRAWINGS

Exemplary embodiments of the present invention will be described in detail based on the following figures, wherein.

DETAILED DESCRIPTION

Figure 1:
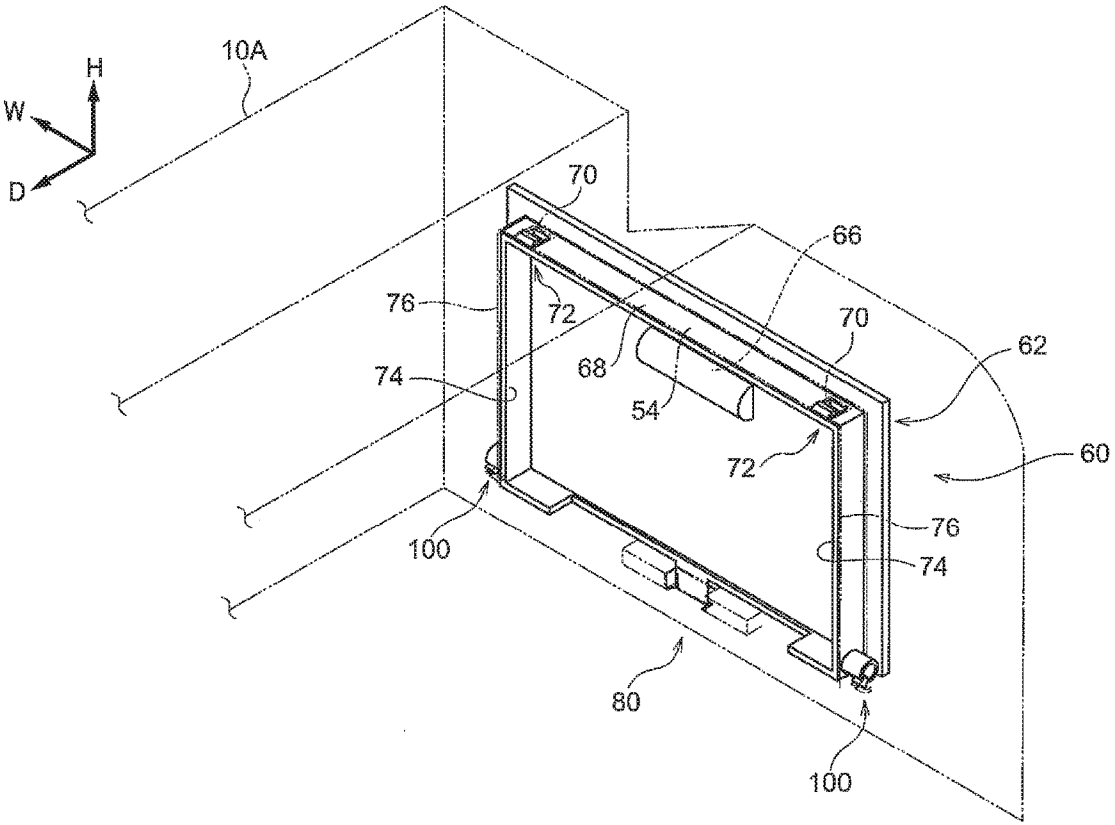
FIG. 1 is a perspective view illustrating an opening/closing device according to an exemplary embodiment of the invention.

Examples of an opening/closing device and an image forming apparatus according to an exemplary embodiment of the invention will be described with reference to FIGS. 1 to 14. Note that arrow H shown in the drawings represents a vertical direction (perpendicular direction) of the apparatus, arrow W represents a width direction (horizontal direction) of the apparatus, and arrow D represents a depth direction (horizontal direction) of the apparatus.

Entire Configuration

Figure 14:
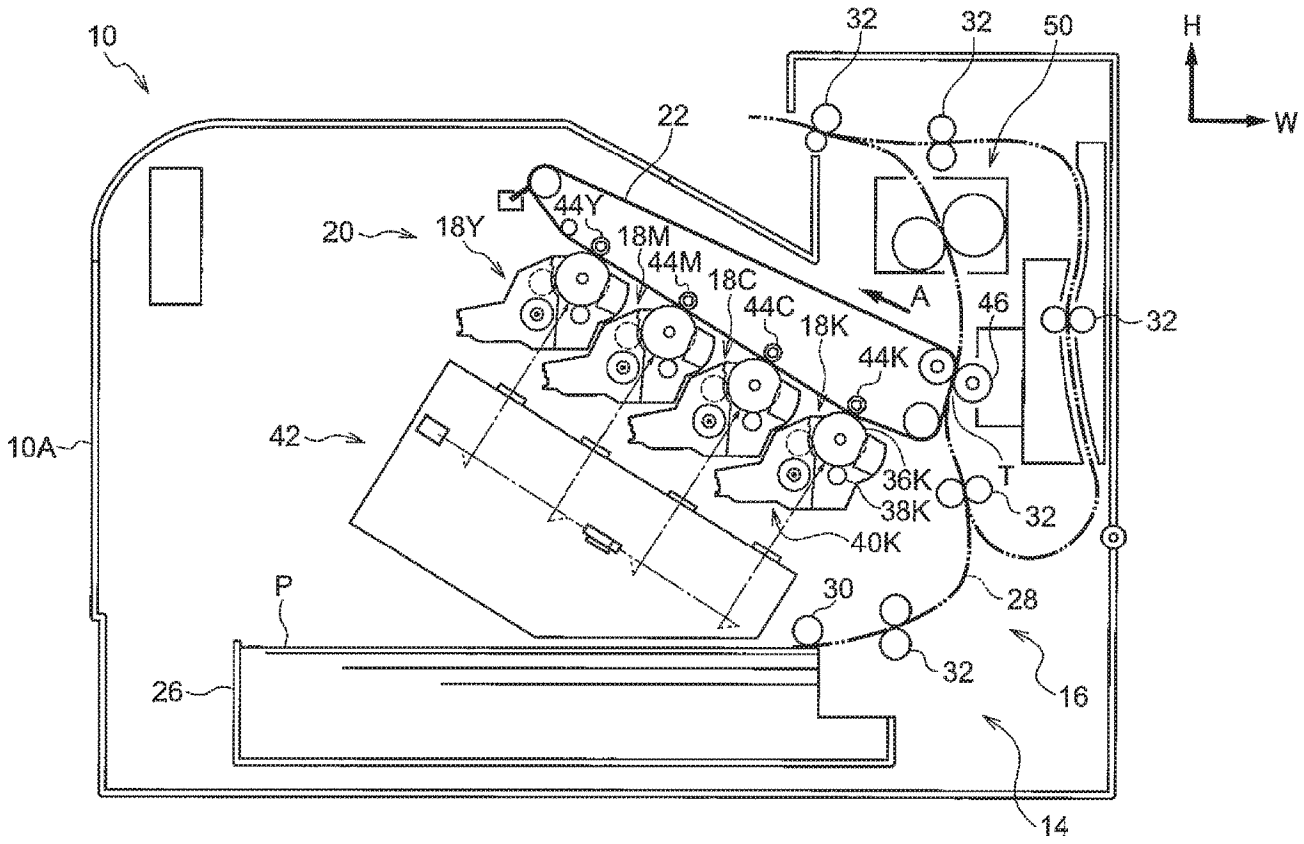
FIG. 14 is a view illustrating a schematic configuration diagram of the image forming apparatus according to the other exemplary embodiment of the invention.

As illustrated in FIG. 14, an image forming apparatus according to the exemplary embodiment includes an accommodating unit 14 in which a sheet member P as a recording medium is accommodated, a transport device 16 that transports the sheet member P accommodated in the accommodating unit 14, and an image forming device 20 that forms an image on the sheet member P transported by the transport device 16 from the accommodating unit 14, in this order from lower side to upper side in the vertical direction (direction of arrow H).

Accommodating Unit

The accommodating unit 14 includes an accommodating member 26 that may be drawn out from the housing 10A of the image forming apparatus 10 on the front side in the depth direction of the apparatus and the sheet members P are stacked in the accommodating member 26. Further, the accommodating unit 14 includes a delivery roll 30 that delivers the sheet members P stacked in the accommodating member 26 to a transport path 28 configuring the transport device 16.

Transport Device

The transport device 16 includes plural transport rolls 32 that transport the sheet member P along the transport path 28.

Image Forming Device

The image forming device 20 includes four image forming units 18Y, 18M, 18C, and 18K of yellow (Y), magenta (M), cyan (C), and black (K). Note that, in the following description, Y, M, C, and K are often omitted in a case where there is no need to distinguish between Y, M, C, and K in the description. In addition, the image forming device 20 includes an exposure device 42 that is provided in each of the image forming units 18 of the respective colors and that irradiates a charged image holding member 36 with exposure light and forms an electrostatic latent image.

The image forming units 18 of the respective colors may be individually mounted to and dismounted from the housing 10A. Also, each of the image forming units 18 of the respective colors includes the image holding member 36, a charging roll 38 that charges a front surface of the image holding member 36, and a developing device 40 that develops the electrostatic latent image formed by exposing the charged image holding member 36 by the exposure device 42 described above such that the electrostatic latent image is visualized as a toner image.

In addition, the image forming device 20 includes an endless transfer belt 22 that performs circular movement in a direction of arrow A in the drawings, and a primary transfer roll 44 that transfers, to the transfer belt 22, the toner image formed by the image forming units 18 of the respective colors. Further, the image forming device 20 includes a secondary transfer roll 46 that transfers, to the sheet member P, the toner image transferred to the transfer belt 22, and a fixing device 50 that heats and pressurizes the sheet member P to which the toner image is transferred so as to fix the toner image to the sheet member P.

Others

In addition, the image forming apparatus 10 includes an opening/closing cover 62 as an example of an opening/closing member by which an opening 52 (refer to FIG. 12) formed at the housing 10A is opened or closed, in order to mount and to dismount the image forming units 18 of the respective colors to and from the housing 10A from the front side in the depth direction of the apparatus. Note that an opening/closing device 60 provided with the opening/closing cover 62 is described below in detail.

Operation of Image Forming Apparatus

In the image forming apparatus 10, an image is formed as follows.

First, the charging rolls 38 of the respective colors, to which a voltage is applied, uniformly and negatively charges the front surfaces of the image holding members 36 of the respective colors with a scheduled potential. Subsequently, the exposure device 42 irradiates the front surfaces of the charged image holding members 36 of the respective colors with exposure light and forms the electrostatic latent image, based on data input from an external device.

In this manner, the electrostatic latent images corresponding to the data are formed on the front surfaces of the image holding members 36 of the respective colors. Further, the developing devices 40 of the respective colors develop the electrostatic latent images and visualize as the toner images. In addition, the toner images formed on the front surfaces of the image holding members 36 of the respective colors are individually transferred to the transfer belt 22 by the primary transfer roll 44.

Here, the sheet member P delivered to the transport path 28 by the delivery roll 30 from the accommodating member 26 is delivered to a transfer position T at which the transfer belt 22 and the secondary transfer roll 46 are in contact with each other. At the transfer position T, the sheet member P is transported between the transfer belt 22 and the secondary transfer roll 46, and thereby the toner image on a front surface of the transfer belt 22 is transferred to the sheet member P.

The toner image transferred to the sheet member P is fixed to the sheet member P by the fixing device 50. Then, the sheet member P on which the toner image is fixed is discharged to the outside of the housing 10A by the transport rolls 32.

Main Configuration

Next, a configuration of the opening/closing device 60 will be described.

Figure 12:
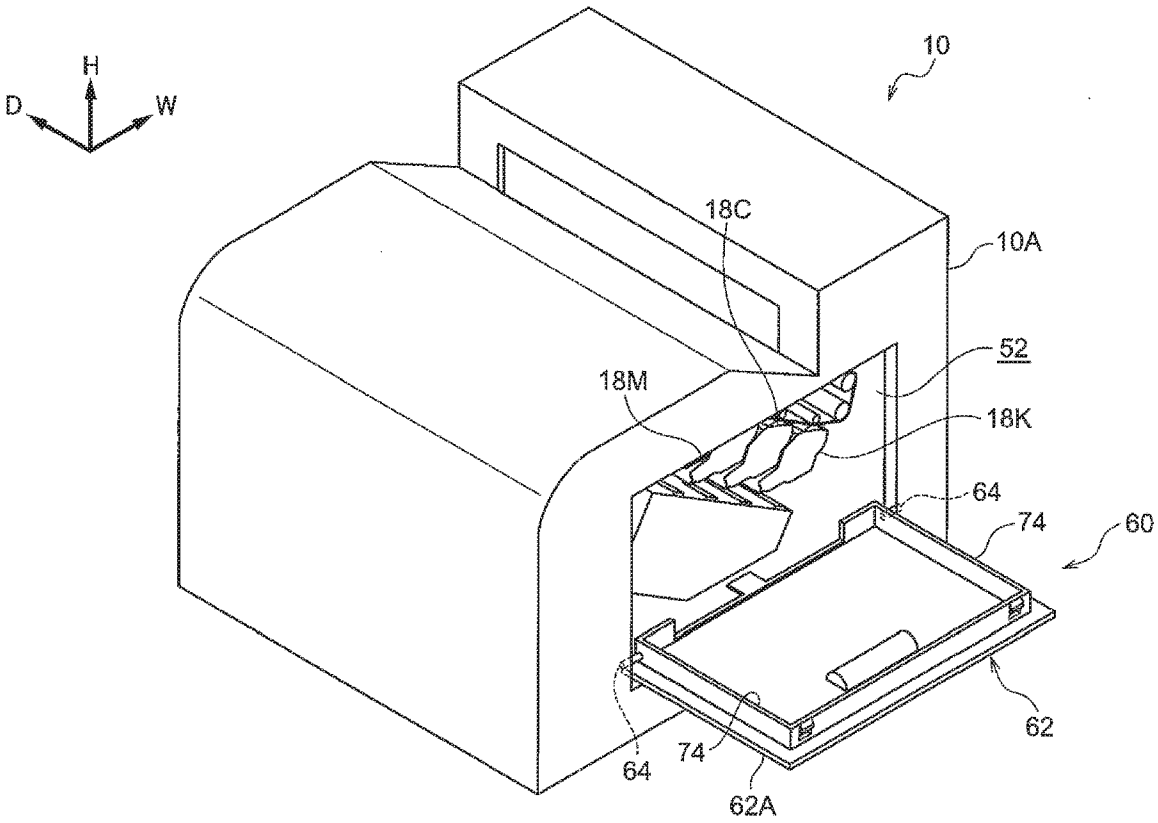
FIG. 12 is a perspective view illustrating an image forming apparatus according to the exemplary embodiment of the invention.
Figure 13:
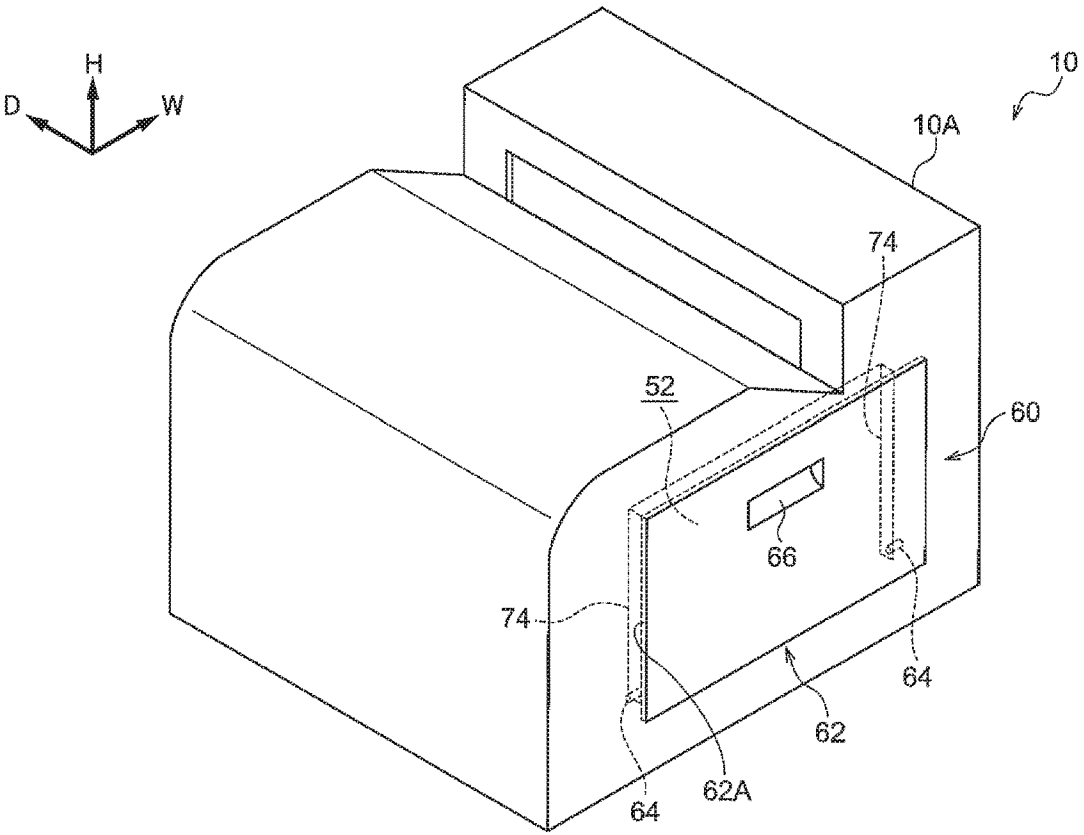
FIG. 13 is a perspective view illustrating the image forming apparatus according to another exemplary embodiment of the invention.

As illustrated in FIGS. 12 and 13, the opening/closing device 60 includes the opening/closing cover 62 by which the opening 52 of the housing 10A is opened or closed.

As illustrated in FIG. 12, the opening 52 of the housing 10A is formed at a portion of the housing 10A on the front side in the depth direction of the apparatus, and has a rectangular shape extending in the width direction of the apparatus. A flange plate 54 (refer to FIGS. 1 and 9) is formed at a portion of the opening 52 on the upper side so as to protrude toward the inner side of the apparatus, and a plate thickness direction thereof is parallel to the vertical direction of the apparatus, and a pair of flange plates 76 (refer to FIGS. 1 and 6) are formed at portions of the opening 52 on both sides in the width direction, and a plate thickness direction thereof is parallel to the width direction of the apparatus. Further, a reinforcement portion 88, which reinforces a portion of the opening 55 on the lower side, is formed at a portion of the opening 52 on the lower side so as to protrude toward the inner side of the apparatus, and has a U shape opened on the front side (right side in FIG. 3) in the depth direction of the apparatus.

Further, a flange plate 68 (refer to FIGS. 2 and 9) is formed at a portion of the opening/closing cover 62 on the upper side so as to protrude toward the inner side of the apparatus, and a plate thickness direction thereof is parallel to the vertical direction of the apparatus, and a pair of flange plates (refer to FIGS. 2 and 6) are formed at portions of the opening/closing cover 62 on both sides in the width direction, and a plate thickness direction thereof is parallel to the width direction of the apparatus.

Figure 6:
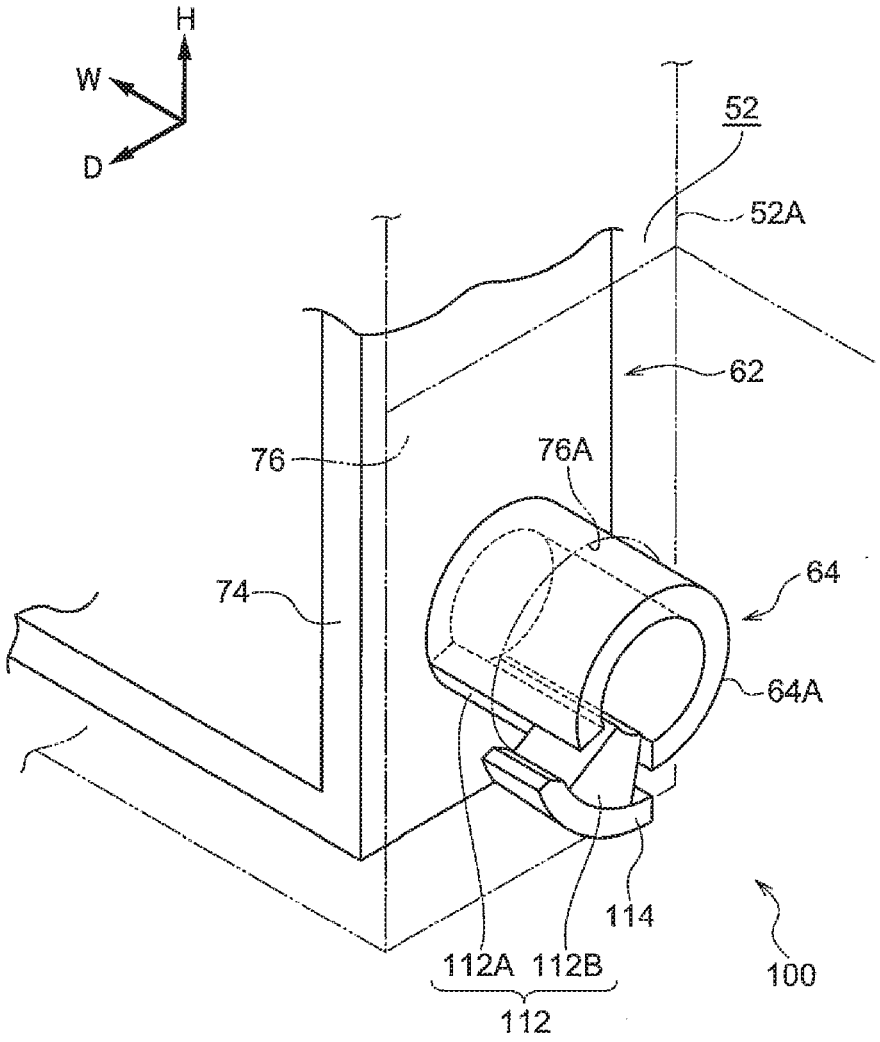
FIG. 6 is a perspective view illustrating a second restraint portion provided in the opening/closing device according to the exemplary embodiment of the invention.

As illustrated in FIG. 13, a pair of shaft members 64 formed of a shaft, about which the opening/closing cover 62 rotates with respect to the housing 10A, are formed at portions on the lower side (an example of one side) of the opening/closing cover 62 disposed at a closing position where the opening 52 is closed. The pair of shaft members 64 are formed on the pair of flange plates 74, respectively, which protrude toward the inner side of the apparatus from portions of the opening/closing cover 62 on outer circumferential edges 62A, and the shaft members protrude on one side and on the other side, respectively, in the width direction of the apparatus. As illustrated in FIG. 6, the shaft members 64 penetrates through through-holes 76A formed in the pair of flange plates 76 protruding from opening edges 52A of the opening 52 of the housing 10A toward the inner side of the apparatus.

Further, as illustrated in FIG. 13, a grip portion 66, which a user grips, is formed at a portion on the upper side (an example of the other side) of the opening/closing cover 62 disposed at the closing position.

In this configuration, the user grips the grip portion 66 and operates the opening/closing cover 62, and thereby the opening/closing cover 62 is to rotate about the shaft members 64. Then, the opening/closing cover 62 is to be disposed at the closing position (refer to FIG. 13) at which the opening 52 of the housing 10A is closed, and at an opening position (refer to FIG. 12) at which the opening 52 of the housing 10A is opened. Note that the opening/closing cover 62 rotating from the closing position is to stop at the opening position by a stopper (not illustrated).

As illustrated in FIG. 12, in a state in which the opening/closing cover 62 is disposed at the opening position and thus the opening 52 is opened, it is possible to mount and dismount the image forming units 18 of the respective colors arranged inside the housing 10A, individually, to and from the housing 10A.

In addition, as illustrated in FIG. 1, a meshed portion 72, which meshes with a meshing portion 70 (refer to FIG. 9) formed at the housing 10A, is formed at a portion of the opening/closing cover 62 disposed at the closing position, on the upper side (an example of the other side).

Further, a first restraint portion 80 as an example of a restraint unit that restrains the opening/closing cover 62 from being deformed due to a release of meshing of the meshing portion 70 with the meshed portion 72, and a second restraint portion 100 as an example of the restraint unit are provided in portions of the opening/closing cover 62 on the lower side (an example of one side).

Meshing Portion and Meshed Portion

Figure 9:
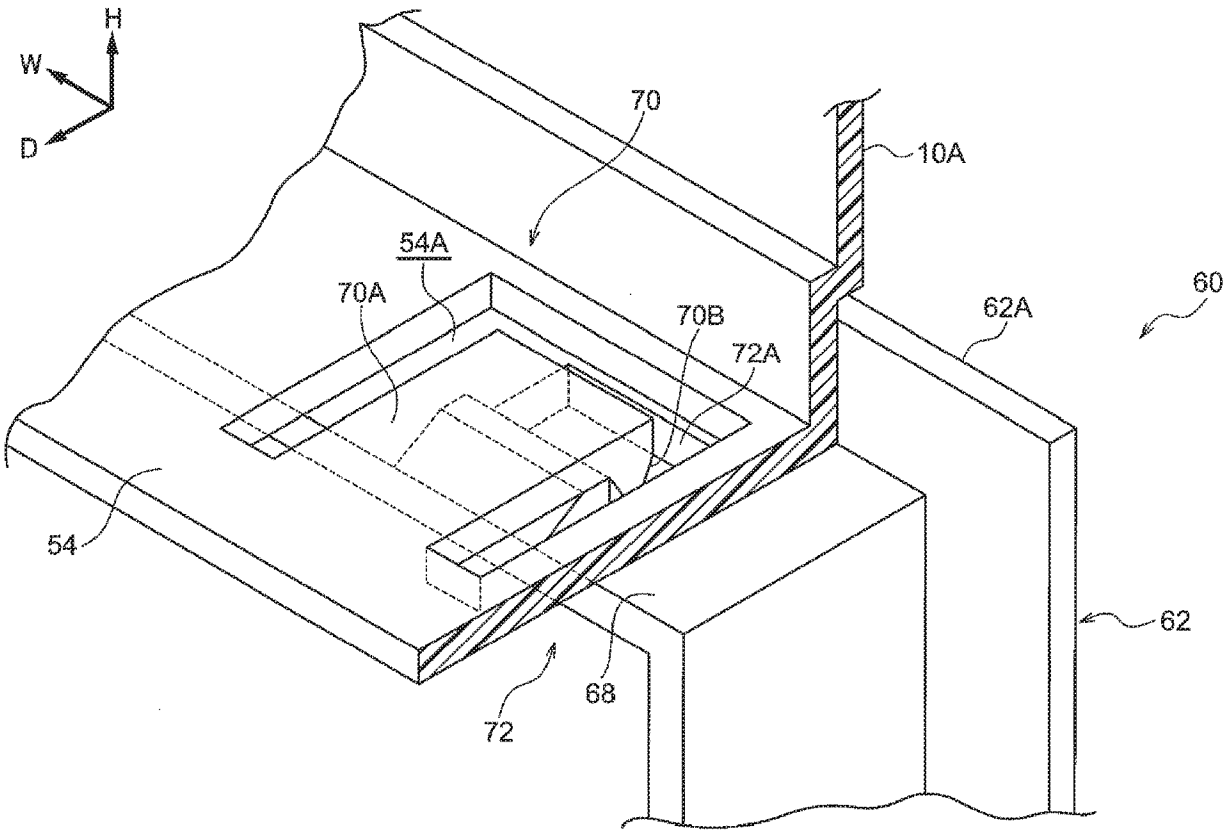
FIG. 9 is a perspective view illustrating a meshing portion provided in the opening/closing device according to the exemplary embodiment of the invention.

As illustrated in FIGS. 1 and 9, the two meshing portions 70 are arranged to interpose the grip portion 66 in the width direction of the apparatus and are formed at the flange plate 54 protruding from the opening edge side of the opening 52 of the housing 10A. Specifically, the meshing portion 70 is formed at a rectangular opening 54A formed at the flange plate 54, and includes a cantilever portion 70A of which a portion on the front side in the depth direction of the apparatus is a free end, and a protruding portion 70B protruding downward from a front end portion of the cantilever portion 70A (refer to FIG. 10A).

Figure 10A:
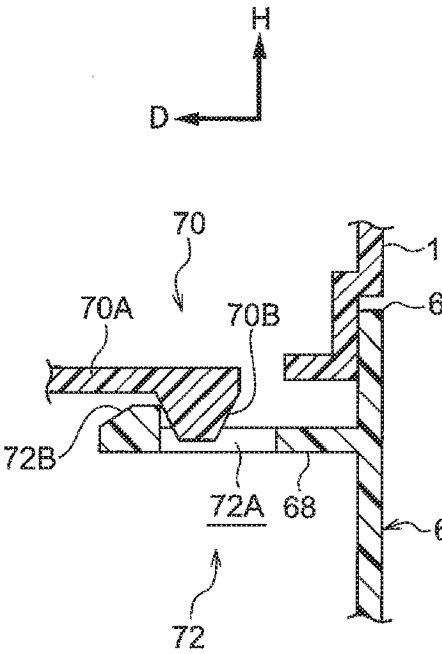
FIGS. 10A to 10C are sectional views illustrating the meshing portion provided in the opening/closing device according to the exemplary embodiment of the invention.

In order to correspond to the meshing portions 70, the two meshed portions 72 are formed at the flange plate 68 protruding from the portion of the opening/closing cover 62 on the outer circumferential edge 62A toward the inner side of the apparatus. Specifically, the meshed portion 72 is formed at the flange plate 68, and includes a rectangular opening 72A into which a portion of the protruding portion 70B on the lower end side is inserted, with the opening/closing cover 62 disposed at the closing position (refer to FIG. 10A). Further, as illustrated in FIG. 10A, the meshed portion 72 includes a protruding portion 72B, which protrudes upward from the flange plate 68 and comes into contact with protruding portion 70B, at the deep side in the depth direction of the apparatus with respect to the protruding portion 70B, with the opening/closing cover 62 disposed at the closing position.

Figure 10B:
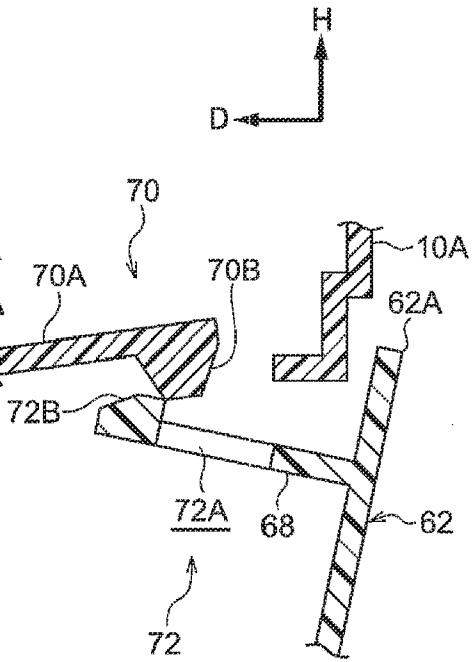
Figure 10C:
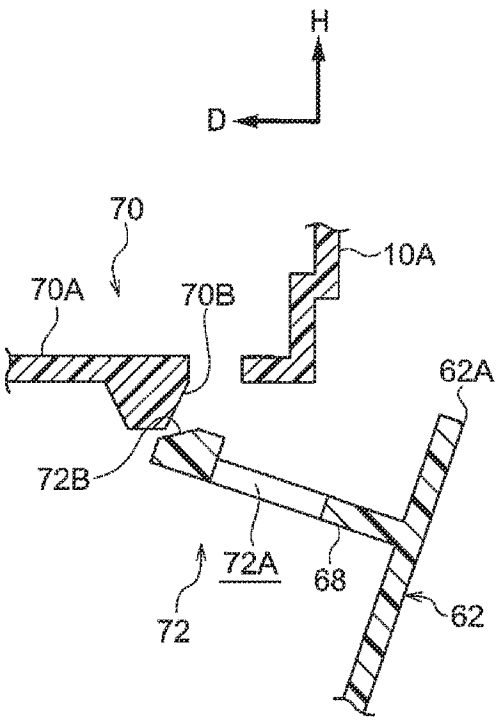

In this configuration, with the opening/closing cover 62 disposed at the closing position, the protruding portion 70B and the protruding portion 72B come into contact with each other in the depth direction of the apparatus, and thereby the meshing portion 70 and the meshed portion 72 meshes with each other such that the opening/closing cover 62 is held at the closing position. In addition, when a user grips the grip portion 66 (refer to FIG. 13) of the opening/closing cover 62 disposed at the closing position and rotates the opening/closing cover 62, as illustrated in FIGS. 10A to 10C, the protruding portion 72B presses the protruding portion 70B such that the cantilever portion 70A is bent. Then, the protruding portion 70B moves over the protruding portion 72B, and thereby the meshing of the meshing portion 70 with the meshed portion 72 is released.

Note that the meshing portion 70 and the meshed portion 72 are members which are released by a force causing the opening/closing cover 62 disposed at the closing position to move toward the opening position.

First Restraint Portion

Figure 2:
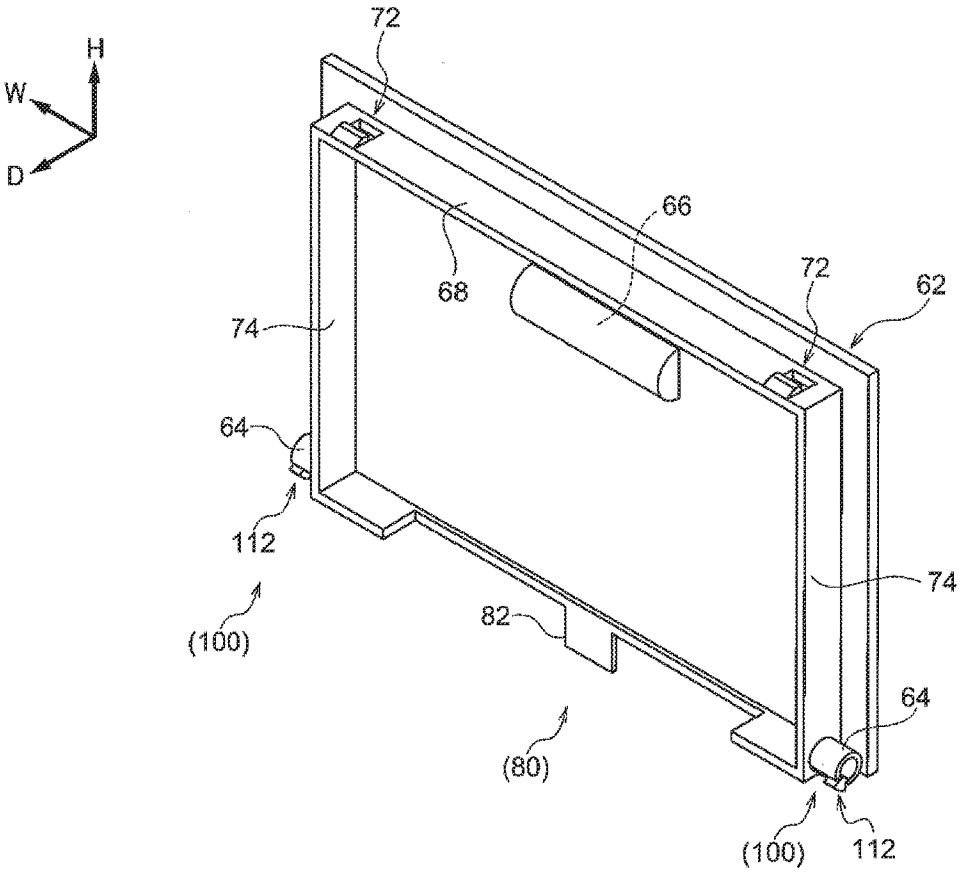
FIG. 2 is a perspective view illustrating an opening/closing member provided in the opening/closing device according to the exemplary embodiment of the invention.

As illustrated in FIG. 1, with the opening/closing cover 62 disposed at the closing position, the first restraint portion 80 is disposed in a portion of the opening/closing cover 62 on the lower side and on the central side in the axial direction (width direction of the apparatus in the exemplary embodiment) of the shaft member 64. As illustrated in FIG. 2, the first restraint portion 80 is formed at a portion of the opening/closing cover 62 on the central side in the width direction of the apparatus, and includes a plate-shaped protruding member 82 protruding downward, with the opening/closing cover 62 disposed at the closing position. Further, as illustrated in FIG. 3, the first restraint portion 80 includes a pair of pinching members 84 having sliding resistance produced against the protruding member 82 due to the rotation of the opening/closing cover 62.

The protruding member 82 has a rectangular shape extending in the width direction of the apparatus, when viewed in a plate thickness direction of the protruding member 82.

Figure 3:
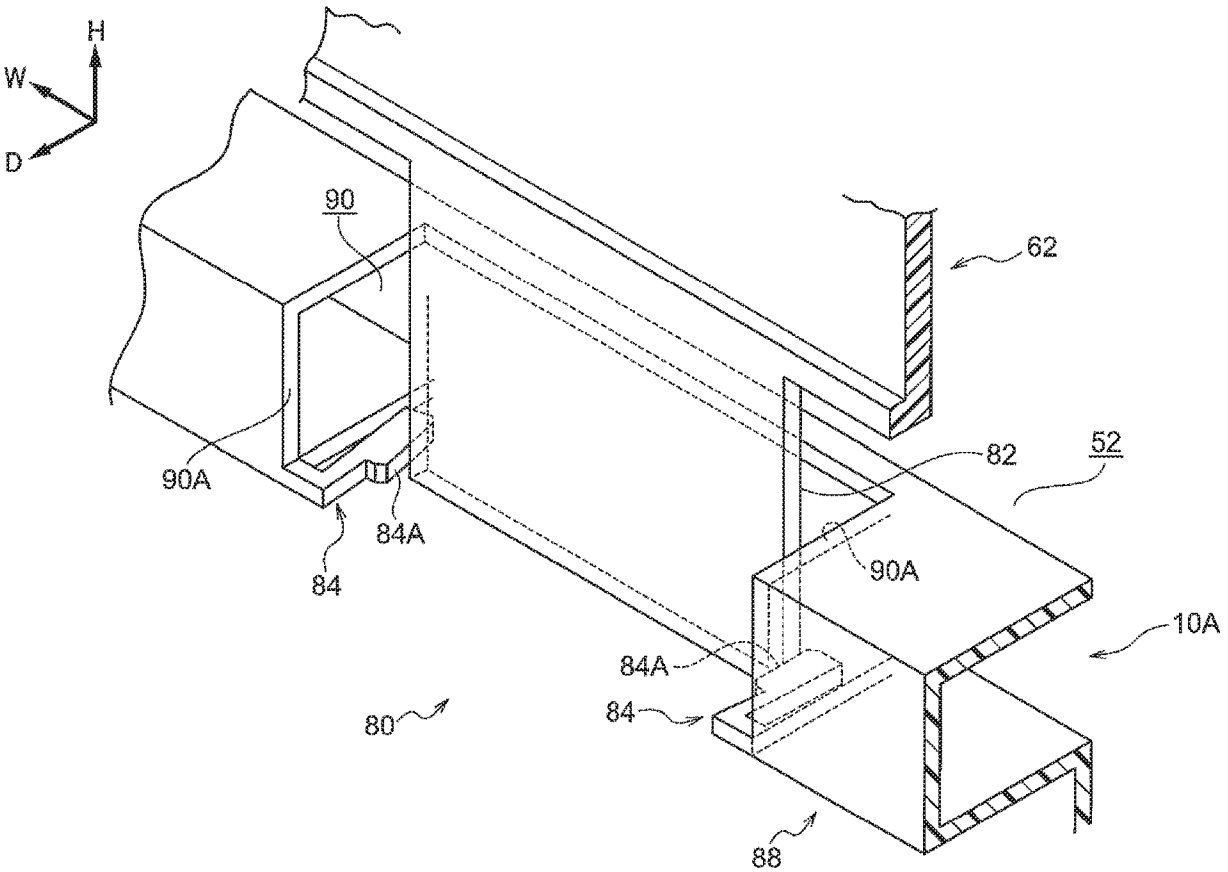
FIG. 3 is a perspective view illustrating a first restraint portion provided in the opening/closing device according to the exemplary embodiment of the invention.

In addition, as illustrated in FIG. 3, the pinching members 84 are formed at portions of the housing 10A on the lower end side of the opening 52. Specifically, an opening 90 having a rectangular shape when viewed in the depth direction of the apparatus is formed at a portion of the reinforcement portion 88 having a U-shaped cross section on the central side in the width direction of the apparatus, and the reinforcement portion is formed at a portion of the housing 10A on the lower end side of the opening 52. The protruding member 82 of the opening/closing cover 62 disposed at the closing position is disposed in the opening 90 so as to be interposed between a pair of opening edges 90A forming the opening 90 and facing each other.

Then, base end portions of the pair of pinching members 84 are individually fixed on the one opening edge 90A and the other opening edge 90A and the front end portions thereof are in a cantilever state by extending to the front side in the depth direction of the apparatus. Projecting portions 84A, which projects toward the protruding member 82 side and come into contact with an end face of the protruding member 82, are formed at portions on the front end side of the pair of pinching members 84, respectively. Then, the pair of pinching members 84 pinch the protruding member 82 in the width direction of the apparatus and are bent. When the opening/closing cover 62 at the closing position rotates and the meshing of the meshing portion 70 with the meshed portion 72 is released, the pair of pinching members 84 has sliding resistance produced against the protruding member 82 (refer to FIGS. 3 and 4).

Second Restraint Portion

As illustrated in FIGS. 1 and 6, the second restraint portions 100 include projecting members 112 that project from the shaft members 64, respectively, to the outside in the radial direction of the shaft member 64, and contact members 114 having sliding resistance produced against the projecting members 112 due to the rotation of the opening/closing cover 62.

Specifically, the shaft member 64 has a cylindrical shape with a part being cut out, and a circumferential wall 64A of the shaft member 64 is separated in a part in the circumferential direction of the shaft member 64. The projecting member 112 is disposed in the portion in which the circumferential wall 64A is separated. The projecting member 112 is formed to extend from the flange plate 74 in the width direction of the apparatus, and includes a cantilever portion 112A in a cantilevered state and a projecting portion 112B that is formed on the front end portion of the cantilever portion 112A and projects from the shaft member 64 to the outside in the radial direction. Similar to the shaft member 64, the projecting member 112 penetrates through the through-hole 76A formed in the flange plate 76.

In addition, the contact member 114 is formed around the through-hole 76A of the flange plate 76. Specifically, the contact member 114 has an arc shape when viewed in the width direction of the apparatus, and protrudes from the flange plate 76 to the side opposite to the opening/closing cover 62. The contact member 114 is in contact with the projecting portion 112B of the projecting member 112 from the outside in the radial direction of the shaft member 64, and the cantilever portion 112A of the projecting member 112 is bent toward the inner side in the radial direction. The contact member 114 is in contact with the projecting member 112, and has sliding resistance produced against the projecting member 112 when the opening/closing cover 62 at the closing position rotates and the meshing of the meshing portion 70 with the meshed portion 72 is released (refer to FIGS. 6 and 7).

Operation of Main Configuration

Next, an operation of the opening/closing device 60 will be described.

With the opening/closing cover 62 disposed at the closing position, as illustrated in FIG. 10A, the meshing portion 70 meshes with the meshed portion 72. In addition, as illustrated in FIG. 3, the pair of pinching members 84 pinch the protruding member 82 in the width direction of the apparatus. Further, as illustrated in FIG. 6, the projecting member 112 and the contact member 114 are in contact with each other and the projecting member 112 is bent.

In a case of opening the opening/closing cover 62 disposed at the closing position, a user grips the grip portion 66 (refer to FIG. 13) and pulls the grip portion 66 to the front side (right side in FIG. 13) in the width direction of the apparatus.

Figure 11B:
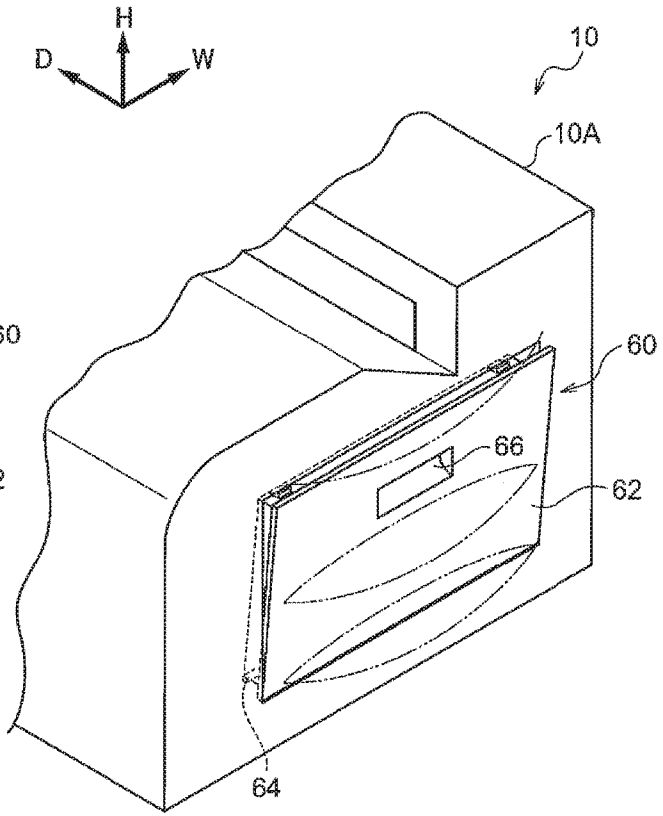
FIGS. 11A and 11B are perspective views illustrating an opening/closing operation of the opening/closing member provided in the opening/closing device according to the exemplary embodiment of the invention.
Figure 11A:
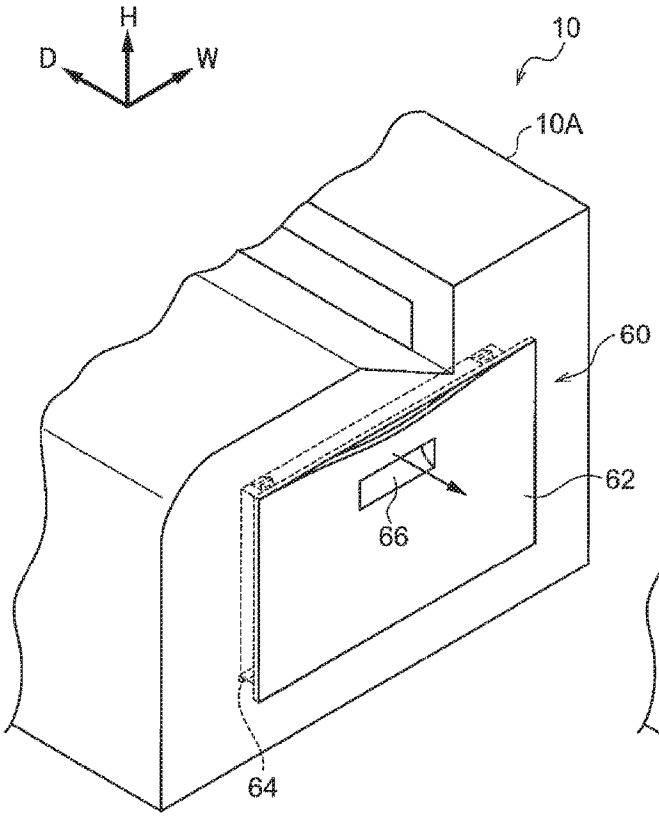

In a state in which the meshing state of the meshing portion 70 with the meshed portion 72 is maintained, as illustrated in FIG. 11A, pulling of the grip portion 66 causes the upper side of the opening/closing cover 62 to be deformed into a curved shape.

Further, as illustrated in FIGS. 10A to 10C, when the grip portion 66 is pulled to the front side in the depth direction of the apparatus, the meshing state of the meshing portion 70 with the meshed portion 72 is released. When the meshing state of the meshing portion 70 with the meshed portion 72 is released, as illustrated in FIG. 11B, the portion of the opening/closing cover 62 on the upper side is separated from the housing 10A, and the portions of the opening/closing cover 62 on both end side in the width direction of the apparatus are deformed and shake in the plate thickness direction of the opening/closing cover 62, and the opening/closing cover 62 vibrates at a primary mode (refer to a two-dot chain line in FIG. 11B).

Figure 4:
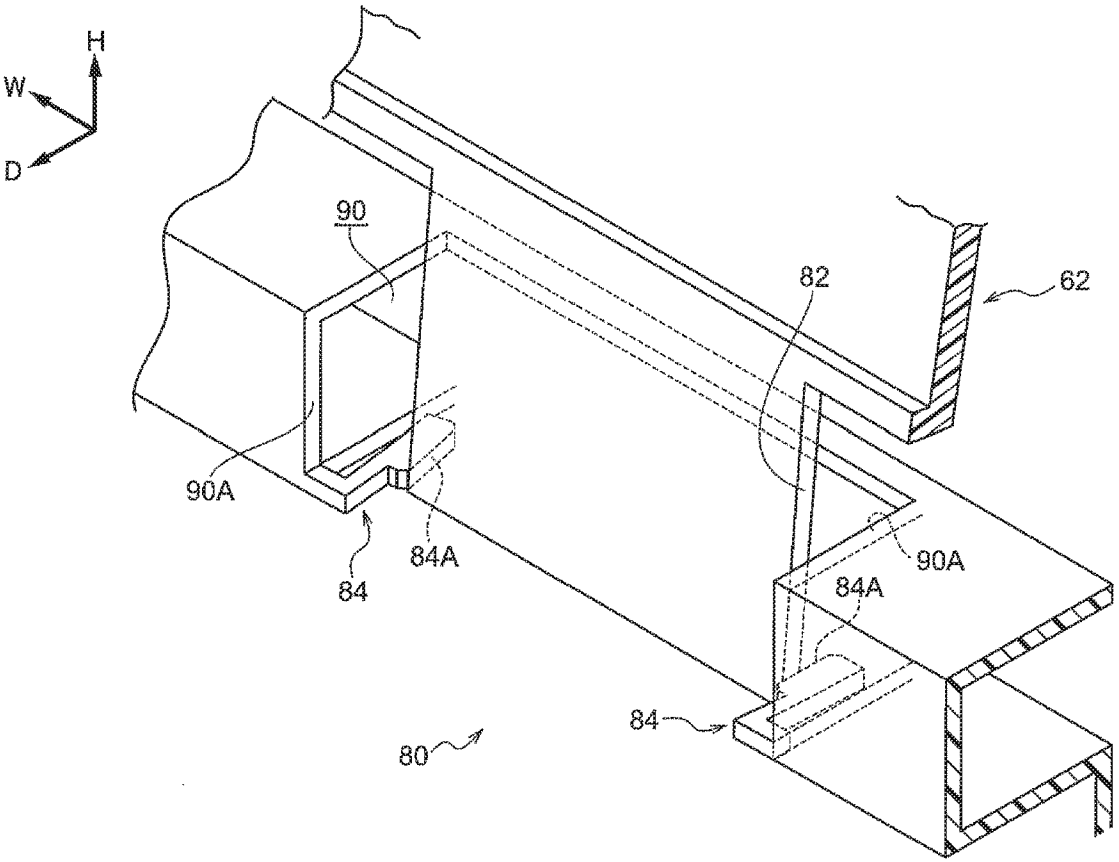
FIG. 4 is a perspective view illustrating the first restraint portion provided in the opening/closing device according to the exemplary embodiment of the invention.
Figure 7:
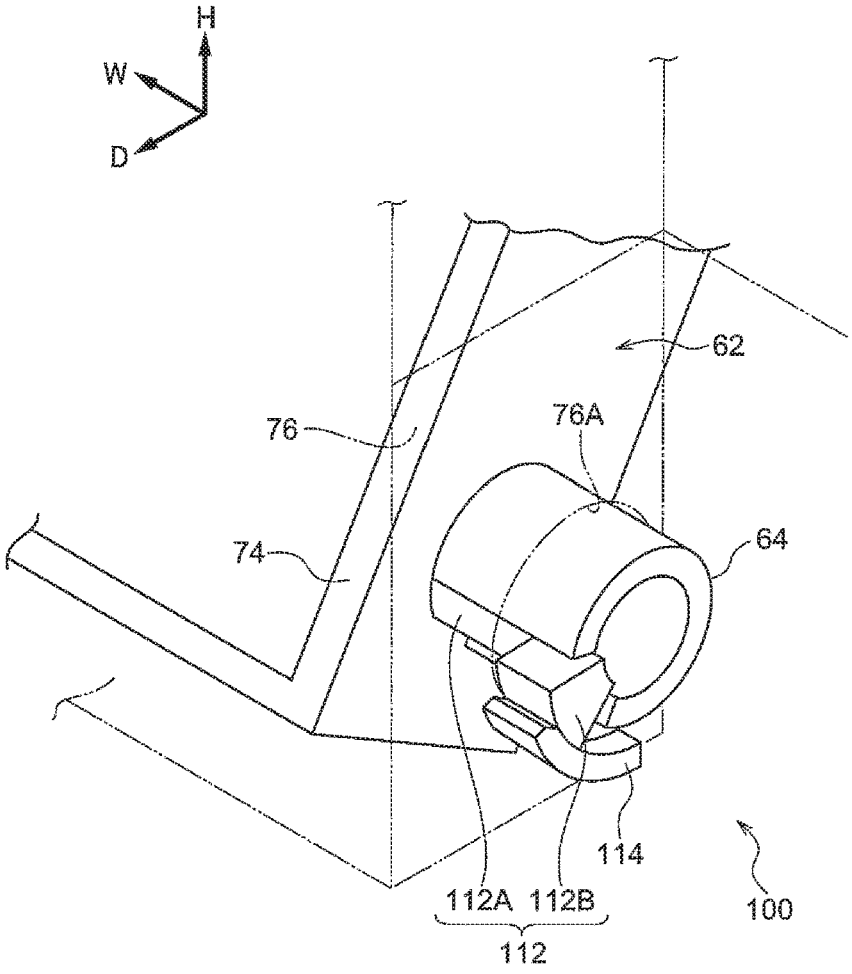
FIG. 7 is a perspective view illustrating the second restraint portion provided in the opening/closing device according to the exemplary embodiment of the invention.

Here, when the meshing state of the meshing portion 70 with the meshed portion 72 is released, as illustrated in FIG. 4, the pair of pinching members 84 pinch the protruding member 82 in the width direction of the apparatus. In addition, as illustrated in FIG. 7, the projecting member 112 and the contact member 114 are in contact with each other and the projecting member 112 is bent.

In other words, in an opening/closing operation of opening and closing the opening 52 by the opening/closing cover 62, when the meshing of the meshing portion 70 with the meshed portion 72 is released, at least the pair of pinching members 84 pinch the protruding member 82. Then, sliding resistance is produced between the pair of pinching members 84 and the protruding member 82.

In addition, in the opening/closing operation of opening and closing the opening 52 by the opening/closing cover 62, when the meshing of the meshing portion 70 with the meshed portion 72 is released, at least the projecting member 112 and the contact member 114 are in contact with each other. Then, sliding resistance is produced between the projecting member 112 and the contact member.

Figure 5:
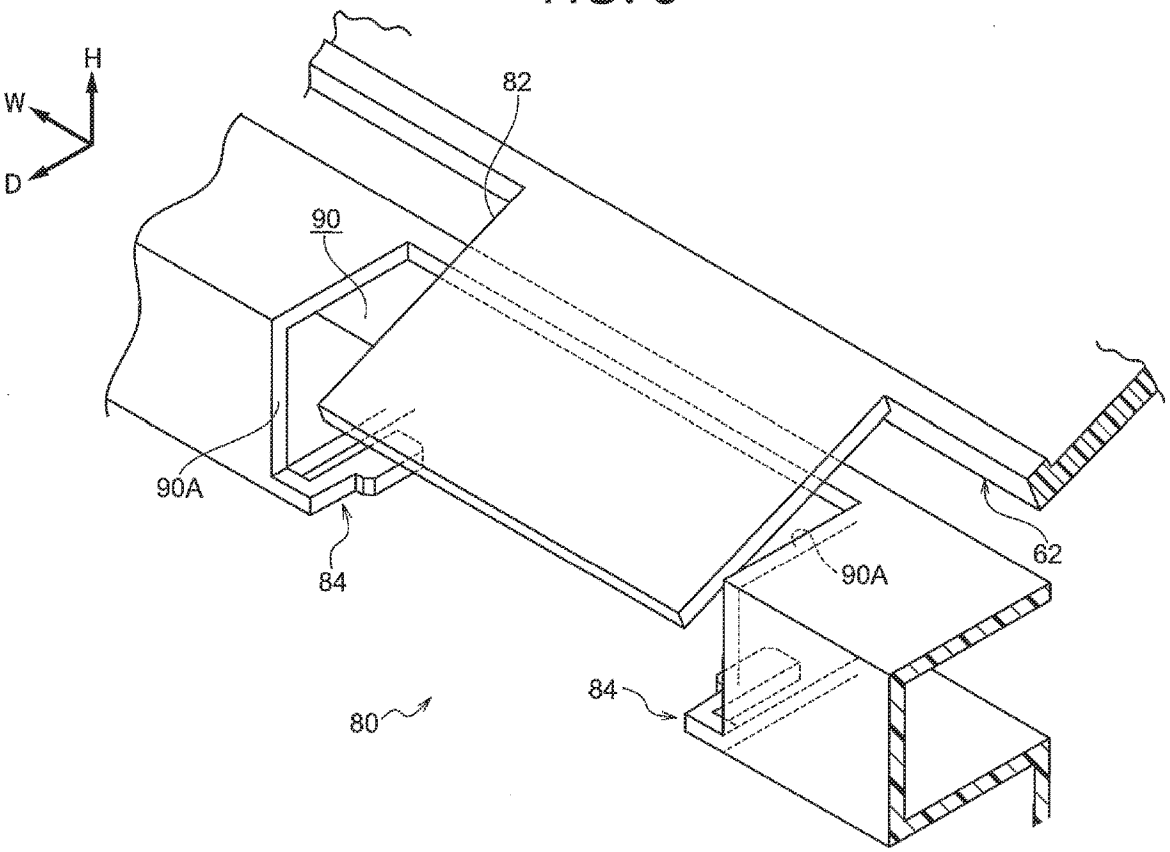
FIG. 5 is a perspective view illustrating the first restraint portion provided in the opening/closing device according to the exemplary embodiment of the invention.
Figure 8:
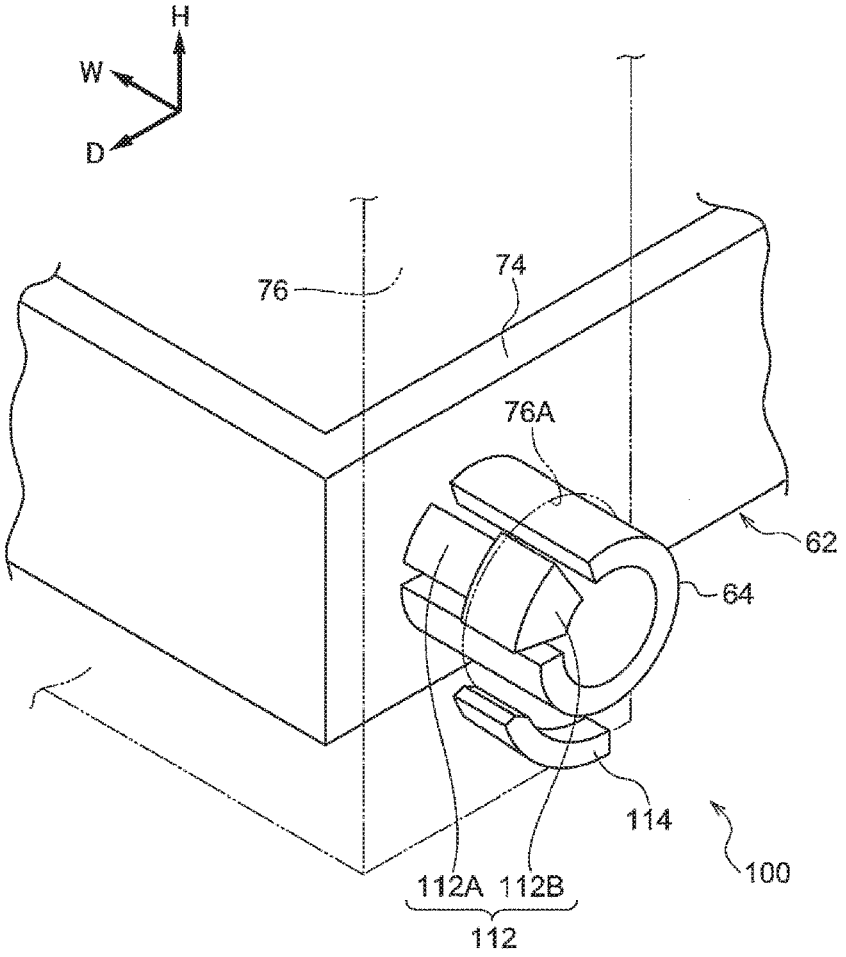
FIG. 8 is a perspective view illustrating the second restraint portion provided in the opening/closing device according to the exemplary embodiment of the invention.

Further, when the grip portion 66 is pulled to the front side in the depth direction of the apparatus, as illustrated in FIG. 12, the opening/closing cover 62 stops at the opening position by a stopper (not illustrated). With the opening/closing cover 62 disposed at the opening position, as illustrated in FIG. 5, the pair of pinching members 84 are separated from the protruding member 82. Further, as illustrated in FIG. 8, the projecting member 112 and the contact member 114 are separated from each other, and the projecting member 112 enters into a free state (state in which the projecting member is not bent).

In this state, the user may mount and dismount the image forming units 18 of the respective colors, individually, to and from the housing 10A.

Note that, in a case where the opening/closing cover 62 disposed at the opening position is to be disposed at the closing position, the user rotates the opening/closing cover 62 disposed at the opening position toward the closing position, and the meshing portion 70 and the meshed portion 72, of which the meshing state is released, mesh with each other. In this manner, the opening/closing cover 62 is disposed at the closing position.

Summing-Up

As described above, when the meshing state of the meshing portion 70 with the meshed portion 72 is released, as illustrated in FIG. 4, the pair of pinching members 84 pinch the protruding member 82 in the width direction of the apparatus. In other words, sliding resistance is produced between the pair of pinching members 84 and the protruding member 82. Therefore, the opening/closing cover 62 is restrained from being deformed due to the release of the meshing of the meshing portion 70 with the meshed portion 72, as compared to a case where the sliding resistance is not produced between the pair of pinching members 84 and the protruding member 82.

The protruding member 82 having sliding resistance produced against the pinching members 84 is formed at a portion of the opening/closing cover 62 on the central side in the axial direction (width direction of the apparatus in the exemplary embodiment) of the shaft member 64. Therefore, the protruding member 82 restrains the opening/closing cover 62 from being deformed at the primary mode, as compared to a case where the protruding member 82 is formed at a portion of the opening/closing cover 62 on the end portion side.

In addition, when the meshing state of the meshing portion 70 with the meshed portion 72 is released, as illustrated in FIG. 7, the projecting member 112 and the contact member 114 are in contact with each other and the projecting member 112 is bent. In other words, sliding resistance is produced between the projecting member 112 and the contact member 114. Therefore, the opening/closing cover 62 is restrained from being deformed due to the release of the meshing of the meshing portion 70 with the meshed portion 72, as compared to a case where the sliding resistance is not produced between the projecting member 112 and the contact member 114. The opening/closing cover 62 is restrained from vibrating due to the release of the meshing of the meshing portion 70 with the meshed portion 72.

In addition, the projecting member 112 having the sliding resistance produced against the contact member 114 projects from the shaft member 64. Therefore, the opening/closing cover 62 is restrained from being deformed due to shaking of the shaft member 64, as compared to a case where the projecting member 112 having the sliding resistance produced against the contact member 114 does not project from the shaft member 64. The opening/closing cover 62 is restrained from vibrating due to the release of the meshing of the meshing portion 70 with the meshed portion 72.

In the image forming apparatus 10, a quality feeling is restrained from being offended when opening the opening/closing cover 62 so as to mount and dismount the image forming units 18 to and from the housing 10A, as compared to a case where the opening/closing cover 62 is not restrained from being deformed due to the release of the meshing of the meshing portion 70 with the meshed portion 72.

The specific exemplary embodiment of the invention is described in detail; however, the invention is not limited to the exemplary embodiment, and it is obvious for those skilled in the art that it is possible to realize other various embodiments within a range of the invention. For example, in the exemplary embodiment described above, the first restraint member 80 and the second restraint member 100 are provided, but one of the members may not be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening/closing device comprising:

an opening/closing member configured to rotate to open and close an opening of a housing;

a shaft member that is formed at a portion on one side of the opening/closing member and is formed of a shaft about which the opening/closing member is configured to rotate with respect to the housing;

a grip portion that is formed at a portion on the other side of the opening/closing member and is configured to be gripped by a user;

a meshed portion that is formed at the portion on the other side of the opening/closing member and is configured to mesh with a meshing portion formed at the housing, with the opening/closing member disposed at a closing position where the opening of the housing is closed; and a restraint unit that is formed at the portion on one side of the opening/closing member and is configured to restrain the opening/closing member from being deformed due to a release of meshing of the meshing portion with the meshed portion, wherein the restraint unit comprises:

a first member that contacts the opening/closing member; and a second member that contacts the housing, wherein the first member is configured to contact the second member.

2. The opening/closing device according to claim 1, wherein the first member comprises a protruding member that is formed at a portion on a central side of the opening/closing member in an axial direction of the shaft member and protrudes from the opening/closing member, and wherein the second member comprises a pair of pinching members that are formed on the housing, pinch the protruding member in the axial direction, and have sliding resistance produced against the protruding member due to rotating of the opening/closing member.

3. The opening/closing device according to claim 2, wherein the pinching members pinch the protruding member, in response to the opening/closing member disposed at the closing position rotating toward an opening position where the opening of the housing is opened and at least meshing of the meshing portion with the meshed portion is released.

4. The opening/closing device according to claim 3, wherein the first member comprises a projecting member that projects from the shaft member to an outside in a radial direction of the shaft member and is bendable in the radial direction, and wherein the second member comprises a contact member that is formed on the housing, comes into contact with the projecting member from the outside in the radial direction, and has sliding resistance produced against the projecting member when the opening/closing member rotates.

5. An image forming apparatus comprising:

a housing;

the opening/closing device according to claim 3 that includes the opening/closing member configured to open and close the opening of the housing; and an image forming unit that is disposed in the housing, is configured to form an image, and is detachable from the housing in response to the opening being opened.

6. The opening/closing device according to claim 4, wherein the contact member comes into contact with the projecting member, in response to the opening/closing member disposed at the closing position rotating toward the opening position where the opening of the housing is opened and at least meshing of the meshing portion with the meshed portion is released.

7. An image forming apparatus comprising:

a housing;

the opening/closing device according to claim 6 that includes the opening/closing member configured to open and close the opening of the housing; and an image forming unit that is disposed in the housing, is configured to form an image, and is detachable from the housing in response to the opening being opened.

8. An image forming apparatus comprising:

a housing;

the opening/closing device according to claim 4 that includes the opening/closing member configured to open and close the opening of the housing; and an image forming unit that is disposed in the housing, is configured to form an image, and is detachable from the housing in response to the opening being opened.

9. The opening/closing device according to claim 2, wherein the first member comprises a projecting member that projects from the shaft member to an outside in a radial direction of the shaft member and is bendable in the radial direction, and wherein the second member comprises a contact member that is formed on the housing, comes into contact with the projecting member from the outside in the radial direction, and has sliding resistance produced against the projecting member when the opening/closing member rotates.

10. The opening/closing device according to claim 9, wherein the contact member comes into contact with the projecting member, in response to the opening/closing member disposed at the closing position rotating toward an opening position where the opening of the housing is opened and at least meshing of the meshing portion with the meshed portion is released.

11. An image forming apparatus comprising:

a housing;

the opening/closing device according to claim 10 that includes the opening/closing member configured to open and close the opening of the housing; and an image forming unit that is disposed in the housing, is configured to form an image, and is detachable from the housing in response to the opening being opened.

12. An image forming apparatus comprising:

a housing;

the opening/closing device according to claim 9 that includes the opening/closing member configured to open and close the opening of the housing; and an image forming unit that is disposed in the housing, is configured to form an image, and is detachable from the housing in response to the opening being opened.

13. An image forming apparatus comprising:

a housing;

the opening/closing device according to claim 2 that includes the opening/closing member configured to open and close the opening of the housing; and an image forming unit that is disposed in the housing, is configured to form an image, and is detachable from the housing in response to the opening being opened.

14. An image forming apparatus comprising:

a housing;

the opening/closing device according to claim 1 that includes the opening/closing member configured to open and close the opening of the housing; and an image forming unit that is disposed in the housing, is configured to form an image, and is detachable from the housing in response to the opening being opened.

15. An opening/closing device comprising:

an opening/closing member configured to rotate to open and close an opening of a housing;

a shaft member that is formed at a portion on one side of the opening/closing member and is formed of a shaft about which the opening/closing member is configured to rotate with respect to the housing;

a grip portion that is formed at a portion on the other side of the opening/closing member and is configured to be gripped by a user;

a meshed portion that is formed at the portion on the other side of the opening/closing member and is configured to mesh with a meshing portion formed at the housing, with the opening/closing member disposed at a closing position where the opening of the housing is closed; and a restraint unit that is formed at the portion on one side of the opening/closing member and is configured to restrain the opening/closing member from being deformed due to a release of meshing of the meshing portion with the meshed portion, wherein the restraint unit includes a projecting member that projects from the shaft member to an outside in a radial direction of the shaft member and is bendable in the radial direction, and a contact member that is formed on the housing, comes into contact with the projecting member from the outside in the radial direction, and has sliding resistance produced against the projecting member when the opening/closing member rotates.

16. The opening/closing device according to claim 15, wherein the contact member comes into contact with the projecting member, in response to the opening/closing member disposed at the closing position rotating toward an opening position where the opening of the housing is opened and at least meshing of the meshing portion with the meshed portion is released.

17. An image forming apparatus comprising:

a housing;

the opening/closing device according to claim 16 that includes the opening/closing member configured to open and close the opening of the housing; and an image forming unit that is disposed in the housing, is configured to form an image, and is detachable from the housing in response to the opening being opened.

18. An image forming apparatus comprising:

a housing;

the opening/closing device according to claim 15 that includes the opening/closing member configured to open and close the opening of the housing; and an image forming unit that is disposed in the housing, is configured to form an image, and is detachable from the housing in response to the opening being opened.

* * * * *